US007114530B2

(12) United States Patent
Moeneclaey et al.

(10) Patent No.: US 7,114,530 B2
(45) Date of Patent: Oct. 3, 2006

(54) RECEIVING GRIPPER FOR A RAPIER LOOM

(75) Inventors: Denis Moeneclaey, Oostnieuwkerke-Staden (BE); Patrick Strubbe, Gistel (BE)

(73) Assignee: PICANOL N.V., Ieper (BE)

( * ) Notice: Subject to any disclaimer, the term of this patent is extended or adjusted under 35 U.S.C. 154(b) by 50 days.

(21) Appl. No.: 10/471,294

(22) PCT Filed: Feb. 8, 2002

(86) PCT No.: PCT/EP02/01305

§ 371 (c)(1),
(2), (4) Date: Sep. 22, 2003

(87) PCT Pub. No.: WO02/077342

PCT Pub. Date: Oct. 3, 2002

(65) Prior Publication Data

US 2004/0089366 A1 May 13, 2004

(30) Foreign Application Priority Data

Mar. 21, 2001 (DE) ..... 101 14 756

(51) Int. Cl.
*D03D 47/16* (2006.01)

(52) U.S. Cl. ..... 139/445; 139/444

(58) Field of Classification Search ..... 139/122, 139/161.1, 438, 442, 447, 444, 196.2, 445
See application file for complete search history.

(56) References Cited

U.S. PATENT DOCUMENTS

| | | | | |
|---|---|---|---|---|
| 3,613,740 | A * | 10/1971 | Geiger | 139/445 |
| 3,986,532 | A | 10/1976 | Volpe | |
| 4,736,777 | A | 4/1988 | Kohler | |
| 4,739,805 | A | 4/1988 | Kohler | |
| 6,866,069 | B1 * | 3/2005 | Moeneclaey et al. | 139/448 |

OTHER PUBLICATIONS

Patent Abstracts of Japan vol. 015, No. 263 (C-0847), Jul. 4, 1991 & JP 03 090657 A (Iwao Yamaji), Apr. 16, 1991.

* cited by examiner

*Primary Examiner*—John J. Calvert
*Assistant Examiner*—Andrew W. Sutton
(74) *Attorney, Agent, or Firm*—Bacon & Thomas, PLLC

(57) ABSTRACT

A receiving gripper for a rapier loom, wherein at least the moving part is made of a ceramic material.

15 Claims, 1 Drawing Sheet

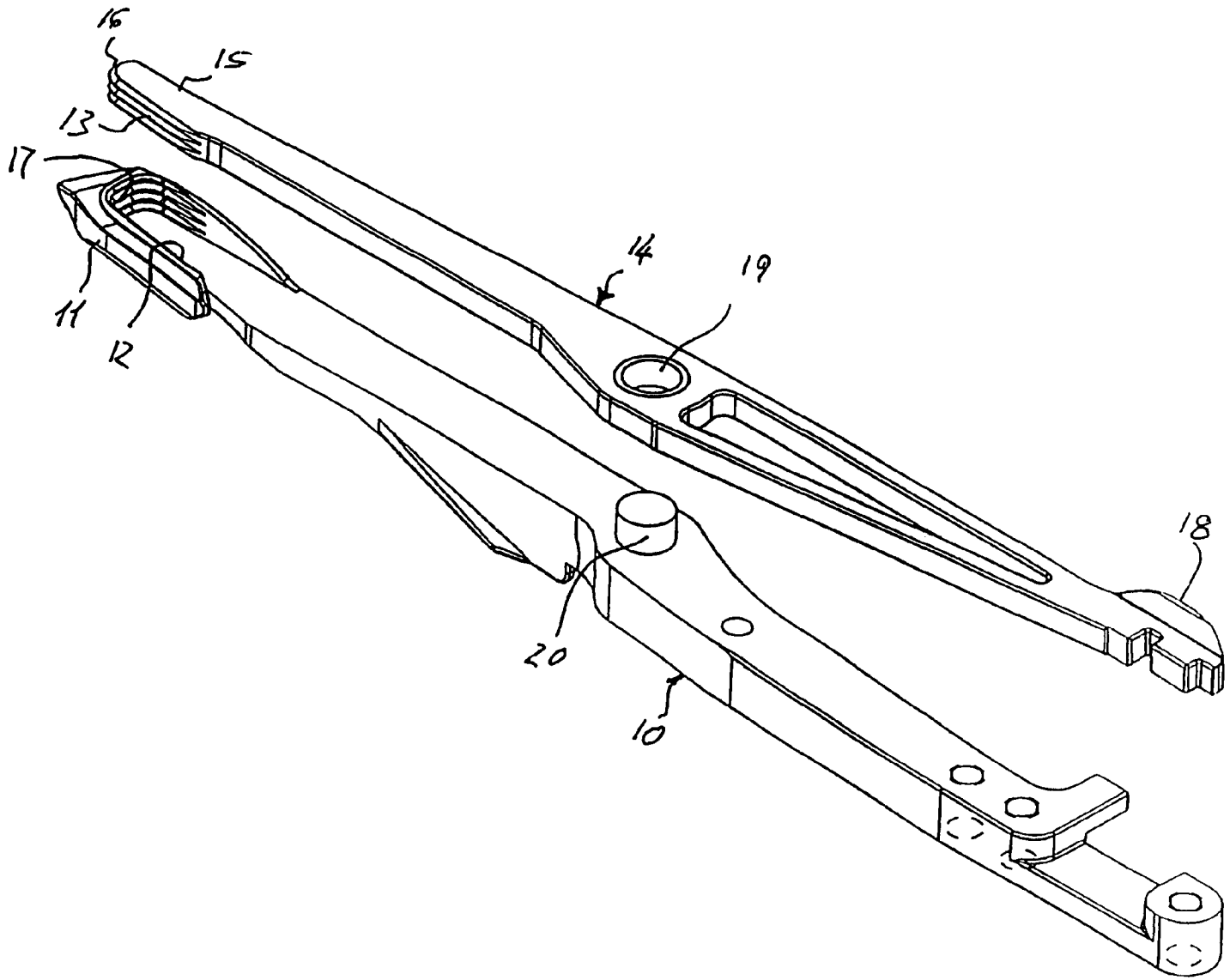
18
19
14
15
16
13
17
11
12
20
10

RECEIVING GRIPPER FOR A RAPIER LOOM

BACKGROUND OF THE INVENTION

A. Field

The present invention relates to a receiving gripper for a rapier loom, said gripper comprising a component fitted with a clamping hook having a clamping surface and comprising a movable component fitted with a mating clamp face associated with said clamping hook's clamping surface.

B. Related Art

In receiving grippers of the above-mentioned type, the component fitted with the clamping hook is mounted to a gripper tape or to a guide element extension of the tape. The movable component is movable in such a manner that its mating clamp face is advanced by a biasing spring toward the clamping hook's clamping surface so the mating clamp face may be lifted off the hook's clamping surface. It is known in this respect to design the movable component as an element moving in the gripper's longitudinal direction of motion (U.S. Pat. Nos. 4,736,777 and 4,739,805), although said element also may be designed as a two-arm lever pivoting about a pivot axis (U.S. Pat. No. 3,986,532). Whether longitudinally translatable or pivotable about a pivot axis, the movable component is typically made of metal.

SUMMARY OF THE DISCLOSURE

The objective of the present invention is to improve the operational reliability of a receiving gripper of the above described kind.

This problem is solved by making the movable component of ceramic material.

The ceramic material provides relatively high rigidity and mechanical strength for the movable component which nevertheless, on account of its comparatively low density, possesses a relatively low weight and a corresponding low angular moment of inertia. As a result, the movable element is relatively insensitive to vibrations or oscillations that otherwise might cause the mating clamp face to separate from the clamping surface of the clamping hook, so that the gripper would accidentally open and lose the thread. Moreover the wear in the region of the mating clamp face and/or in the zone of a bearing and/or in the range of operation of a drive cam or the like shall be substantially lower than if the movable component were made of a metal. As a result insets to increase wear resistance or mechanical strength are not needed in the general case.

In a further embodiment of the invention, the component fitted with the clamping hook also is made of ceramic. In this manner the overall gripper weight may be reduced while simultaneously decreasing wear in the region of the clamping hook.

BRIEF DESCRIPTION OF THE DRAWINGS

Further features and advantages of the present intention are explained in the description below of the illustrative embodiment shown in the drawing.

DETAILED DESCRIPTION OF THE PREFERRED EMBODIMENT OF THE INVENTION

The drawing is an exploded view a component which is firmly affixed to a gripper tape or to a guide element, the component being fitted with a clamping hook, and another component being movable relative to the former component.

The receiving gripper is only partly shown in the drawing and comprises a component 10 mounted firmly to a gripper tape or to a guide element extension of said tape. The forward end of this component 10 is fitted with a clamping hook 11 beginning at the tip and comprising at its rear a heel hook. This heel hook subtends a clamping surface 12 which is paired with a mating clamp face 13 of a movable component 14.

The movable component 14 is a two-arm lever the head 15 of which faces the clamping hook 11 and is fitted with the mating clamp face 13. The end face of the head 15 is cross-sectionally contoured 16 to match a contour 17 on the inside of the clamping hook 11. The significance of these contours 16, 17 is explained in applicant's parallel patent application (internal file P 40197 DE). The clamping surface 12 and/or the mating clamp face 13 on the other hand may be smooth or flat.

The second arm of lever 14 constitutes a drive element 18 associated with a not-shown stop. When the drive element 18 abuts against said stop, the lever 14 is pivoted about its pivot axis and as a result the gripper is be opened, that is, the mating clamp face 13 is lifted off the clamping surface 12. The two-arm lever 14 is fitted between the two arms with a bearing opening 19 by means of which it is mounted on a bolt or a pivot stub 20 projecting from the component 10. An unshown compression spring acts on said arm of the lever 14 within the operational range of the drive element 18 and biases the lever 14 in a manner that the mating clamp face 13 is pressed against the clamping surface 12 of the clamping hook 11. The lever 14 is designed in such manner that its center of mass is located at least approximately at the pivot axis defined by the bearing clearance 19 and the bolt or pivot stub 20. The purpose of this design is explained in parallel application of this applicant (internal file P 40198 DE).

The movable component constituting the lever 14 is made of a ceramic material. This preferably powder ceramic material is formed into the shape of the lever 14 as shown and then sintered or baked. Present-day techniques allow manufacturing the lever 14 in its final form, namely without the need for finishing work. That is, without the need to finish the areas of the mating clamp face 13, the guide element 16, the drive element 18 and the bearing opening 19. Ceramic material offers the advantage of comparatively low density. Moreover the ceramic material offers high mechanical strength and great hardness. Accordingly, wear will be slight in the region of the mating clamp face 13, of the drive element 18 and the bearing opening 19. Furthermore the danger from vibrations is relatively low, in particular when the center of mass is located in the vicinity of the pivot system 19, 20. As a result, the required forces from the compression spring may be decreased, and consequently wear also may be substantially reduced in the region of the bearing.

In most cases the component 10 will be made of metal, the bearing stub 20 being fitted with a wear-resistant sleeve. Advantageously, however, the said component 10 also shall be made, together with the clamping hook 11 and the bearing stub 20, of a ceramic material.

The invention was described above by means of an illustrative embodiment comprising a movable component in the form of a pivoting lever 14. Obviously, the invention also applies to movable receiving gripper components which cannot be pivoted and instead are reciprocated longitudinally in the manner illustratively known from U.S. Pat. Nos. 4,520,851; 4,736,777 and 4,739,805. In such case, the drive element also may be made of ceramic material, and will be linked to the longitudinally movable component to transmit the longitudinal motion.

The invention claimed is:

1. A receiving gripper for a rapier loom comprising:

a fixed gripper arm which includes a clamping hook having a clamping surface; and a gripper arm movable relatively to the fixed gripper arm and having a clamping surface mating with the clamping surface of the clamping hook;

wherein the movable gripper arm including its clamping surface is completely made of ceramic material and the clamping surface of the hook of the fixed gripper arm is made of ceramic material.

2. Receiving gripper as claimed in claim 1, wherein the movable gripper arm is a two-arm lever, one arm of which is fitted with a head including the mating clamping surface.

3. Receiving gripper as claimed in claim 2, wherein the second arm of the lever is fitted with a drive element.

4. Receiving gripper as claimed in claim 2, wherein the lever is provided between its arms with a bearing opening.

5. Receiving gripper as claimed in claim 4, wherein the center of mass of the lever is located approximately at the bearing opening.

6. A receiving gripper for a rapier loom, comprising a fixed gripper arm which includes a clamping hook having a clamping surface and a movable gripper arm movable relative to the fixed gripper arm, said movable gripper arm having a clamping surface mating with the clamping surface of the clamping hook, wherein the fixed gripper arm including its clamping hook and its clamping surface as well as the movable gripper arm including its clamping surface, are completely made of ceramic material.

7. Receiving gripper as claimed in claim 6, wherein the movable gripper arm is a two-arm lever, one arm of which is fitted with a head including the mating clamping surface.

8. Receiving gripper as claimed in claim 7, wherein the second arm of the lever is fitted with a drive element.

9. Receiving gripper as claimed in claim 6, wherein the lever is provided between its arms with a bearing opening.

10. Receiving gripper as claimed in claim 9, wherein the center of mass of the lever is located approximately at the bearing opening.

11. A receiving gripper for a rapier loom comprising:

a fixed gripper arm which includes a clamping hook having a clamping surface; and a gripper arm movable relatively to the fixed gripper arm and having a clamping surface mating with the clamping surface of the clamping hook;

wherein the movable gripper arm including its clamping surface is completely made of ceramic material.

12. Receiving gripper as claimed in claim 11, wherein the movable gripper arm is a two-arm lever, one arm of which is fitted with a head including the mating clamping surface.

13. Receiving gripper as claimed in claim 12, wherein the second arm of the lever is fitted with a drive element.

14. Receiving gripper as claimed in claim 12, wherein the lever is provided between its arms with a bearing opening.

15. Receiving gripper as claimed in claim 14, wherein the center of mass of the lever is located approximately at the bearing opening.

* * * * *